US007657349B2

(12) United States Patent
Hawthorne

(10) Patent No.: US 7,657,349 B2
(45) Date of Patent: Feb. 2, 2010

(54) METHOD OF MARSHALLING CARS INTO A TRAIN

(75) Inventor: Michael J. Hawthorne, Arlington, TX (US)

(73) Assignee: New York Air Brake Corporation, Watertown, NY (US)

( * ) Notice: Subject to any disclaimer, the term of this patent is extended or adjusted under 35 U.S.C. 154(b) by 607 days.

(21) Appl. No.: 11/583,734

(22) Filed: Oct. 20, 2006

(65) Prior Publication Data

US 2008/0097659 A1 Apr. 24, 2008

(51) Int. Cl.
*G06F 19/00* (2006.01)

(52) U.S. Cl. ..... 701/19; 701/117

(58) Field of Classification Search ..... None
See application file for complete search history.

(56) References Cited

U.S. PATENT DOCUMENTS

| | | | |
|---|---|---|---|
| 3,689,788 | A | 9/1972 | Wong |
| 3,844,514 | A | 10/1974 | DiPaola et al. |
| 4,610,206 | A | 9/1986 | Kubala et al. |
| 4,766,815 | A | 8/1988 | Chongen et al. |
| 5,301,906 | A | 4/1994 | Bodnar, II |
| 5,676,337 | A | 10/1997 | Giras et al. |
| 5,758,848 | A | 6/1998 | Beule |
| 6,135,396 | A | 10/2000 | Whitfield et al. |
| 6,377,877 | B1 | 4/2002 | Doner |
| 6,418,854 | B1 | 7/2002 | Kraft |
| 6,421,587 | B2 | 7/2002 | Diana et al. |
| 6,516,727 | B2 | 2/2003 | Kraft |
| 6,637,703 | B2 | 10/2003 | Matheson et al. |
| 6,789,005 | B2 | 9/2004 | Hawthorne |
| 6,832,204 | B1 | 12/2004 | Doner |
| 6,856,865 | B2 | 2/2005 | Hawthorne |
| 7,546,185 | B2 * | 6/2009 | Muinonen et al. ..... 701/19 |
| 2007/0005200 | A1 | 1/2007 | Wills et al. |

FOREIGN PATENT DOCUMENTS

| | | | |
|---|---|---|---|
| WO | WO 02/053443 | A1 | 7/2002 |
| WO | WO 2006/099387 | A2 | 9/2006 |

* cited by examiner

*Primary Examiner*—Michael J. Zanelli

(57) ABSTRACT

A method of optimizing marshalling rail cars into a train at a site and includes determining the track configuration at the site; determining location on the tracks of cars to be marshaled; determining characteristics of the cars to be marshaled; and determining marshalling rules. A calculation is performed to determine an optimum sequence of moves to marshal the cars into a train from the determined track configuration, location on the tracks of cars, characteristics of the cars and the marshalling rules. The resulting sequence is outputted.

21 Claims, 4 Drawing Sheets

METHOD OF MARSHALLING CARS INTO A TRAIN

BACKGROUND AND SUMMARY OF THE INVENTION

The present invention relates generally to railroad hump yards and, more specifically, to a method of marshalling cars into a train.

Railroads use hump yards to marshal trains. The hump yard basically provides a switch point where a car can be attached to one of many trains. A string of cars is pushed up an incline by a switcher locomotive. When the car reaches the crest of the incline or hump, the car is released from the string and rolls down the hump to pick up speed. Part way down the hill or hump, the car will encounter a retarding device that will slow the car to the proper speed. The ideal speed represents just enough energy to cause the couplers of the mating cars to engage, but no more. The car will also encounter a series of switches to direct the car to the appropriate train. Any excess speed or energy as the car couples to the train will be transferred to the car and lading. The retarding devices and the switches are generally controlled remotely from a hump yard tower.

Typical examples of hump or classification yards are shown in U.S. Pat. Nos. 4,610,206 and 5,758,848. A review of methods for sorting the cars for marshalling in the switch yards or other locations is described in U.S. Pat. No. 6,418,854. Outbound trains are built using proper standing order for departure directly on classification tracks using a continuously sustainable multi-stage sorting process. The use of a multi-stage switching yard with two or more subyards is described in U.S. Pat. No. 6,516,727.

Also, in the hump or other yards, the locomotive may be controlled from a remote location by an operator on the ground. The remote control locomotive (RCL) systems usually include an RCL device carried by the operator. In the industry, these are known as "belt packs." The location of the RCL operator is important to the management of the yard, as well as the control signals that are sent to the locomotive. From the ground perspective, the RCL operator does not always have an appropriate perspective of the total layout of the yard, much less the total train. Also, since he is not on the train, he cannot sense the forces in the train by the seat of his pants, as most well-trained over the road operators can. An advanced RCL system and method are shown in U.S. Pat. No. 6,789,005, which is incorporated herein by reference.

The present invention is a method of optimizing marshalling rail cars into a train at a site and includes determining the track configuration at the site; determining location on the tracks of cars to be marshaled; determining characteristics of the cars to be marshaled; and determining marshalling rules. A calculation is performed to determine an optimum sequence of moves to marshal the cars into a train from the determined track configuration, location on the tracks of cars, characteristics of the cars and the marshalling rules. The resulting sequence is outputted. The moves of the optimum sequence to marshal the cars into a train are performed. Recalculation of the optimum sequence while the moves may be performed.

The output may be one or more of a printout, a screen and oral. The sequence may be outputted to a screen with a checklist and including updating the checklist in response to entries from an operator.

The calculating may be performed on a processor and the results of the determining steps may be inputted in and/or stored on the processor. The site location and car locations may be determined by a global position type system and inputted into the processor; and the track configuration at the site may be determined by the processor from stored track configurations corresponding to the site location. At least two of the location of the cars, characteristics of the cars and marshalling rules may be determined and transmitted to the processor. The processor may be one of a handheld device, a remote control locomotive device, a locomotive processor and a tower/remote processor.

The actual moves performed for the marshalling of the cars into the train may be determined and stored. The actual moves may be compared with the optimum sequence and a report prepared.

The marshalling rules include car destination and route to be taken to its destination. One or more of fuel economy, time to destination and in-train force of the marshaled train over the route may be determined and a report be prepared of the determination. The location of the cars in the marshaled train may be changed based on the report and, recalculation of one or more of fuel economy, time to destination and in-train force of the new marshaled train over the route and outputting a report of the determination may be performed. The recalculation is performed one of automatically and in response to operator input.

These and other aspects of the present invention will become apparent from the following detailed description of the invention, when considered in conjunction with accompanying drawings.

DETAILED DESCRIPTION OF THE PREFERRED EMBODIMENTS

Figure 1:
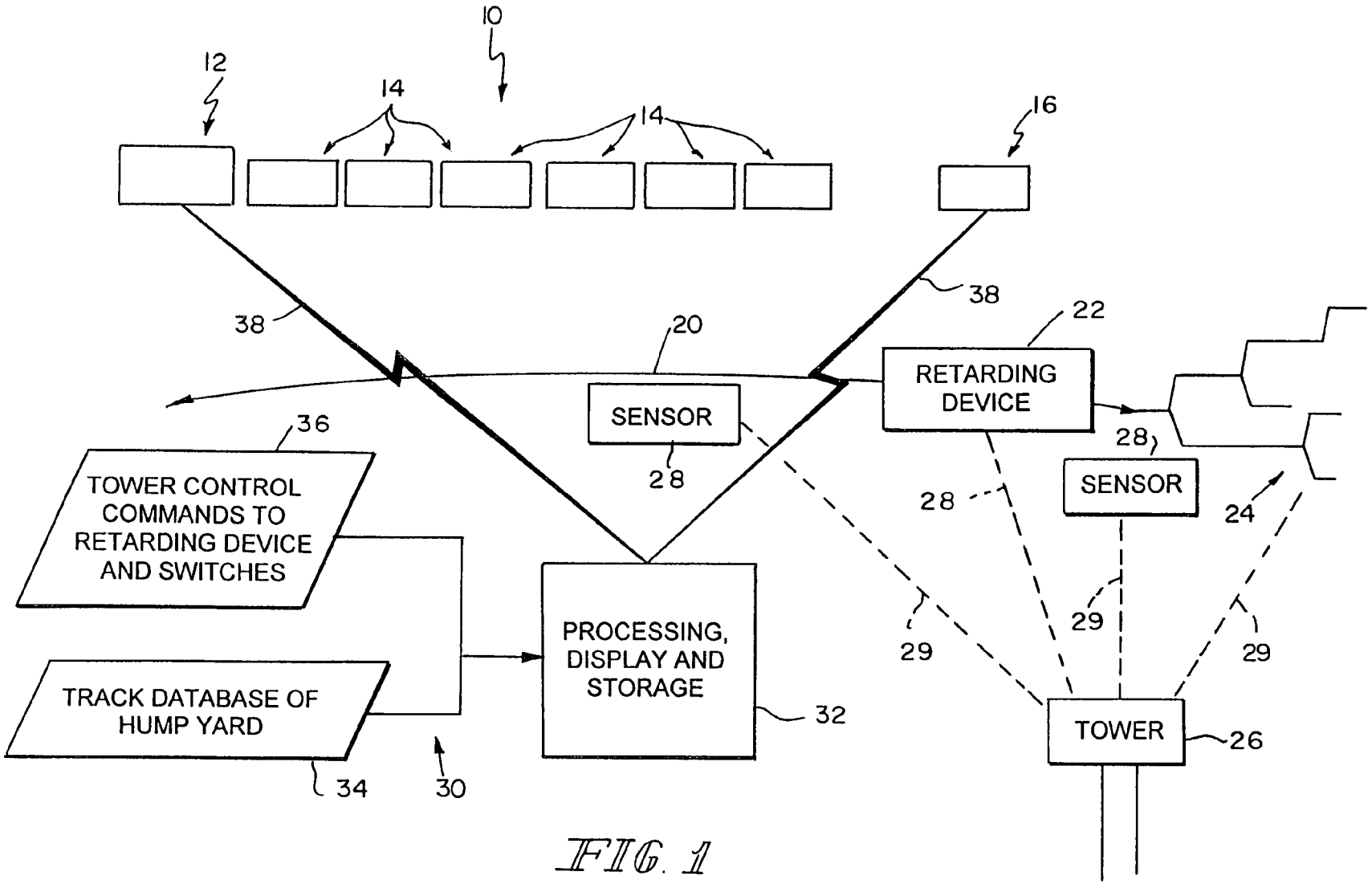
FIG. 1 is a schematic view of a hump yard, including the management system.

A train 10 having a locomotive 12 and a plurality of cars 14 connected thereto is illustrated in FIG. 1. A car 16, which has been released from the marshaled cars 14, is illustrated also. These are shown above a hump track profile 20, which includes a retarding device 22 and a switching network 24. A tower 26 monitors and controls the retarding device 22 and the switching network 24 via communication links 29. Sensors 28, including but limited to cameras, may also be positioned along the hump track path and also connected to the tower 26 via communication links 29. These may be hard wired or radio. As previously described, the general operation of the hump yard is well known, with the locomotive positioning the cars at the crest of the hump and releasing the cars to roll down the hump path through retarding device 22 and switching network 24 to be assembled on different trains. The ultimate goal is to have the car 16 arrive with just enough force to close the coupling, though not creating excessive force in the remainder of the trains to which it is to be a part of.

Figure 2:
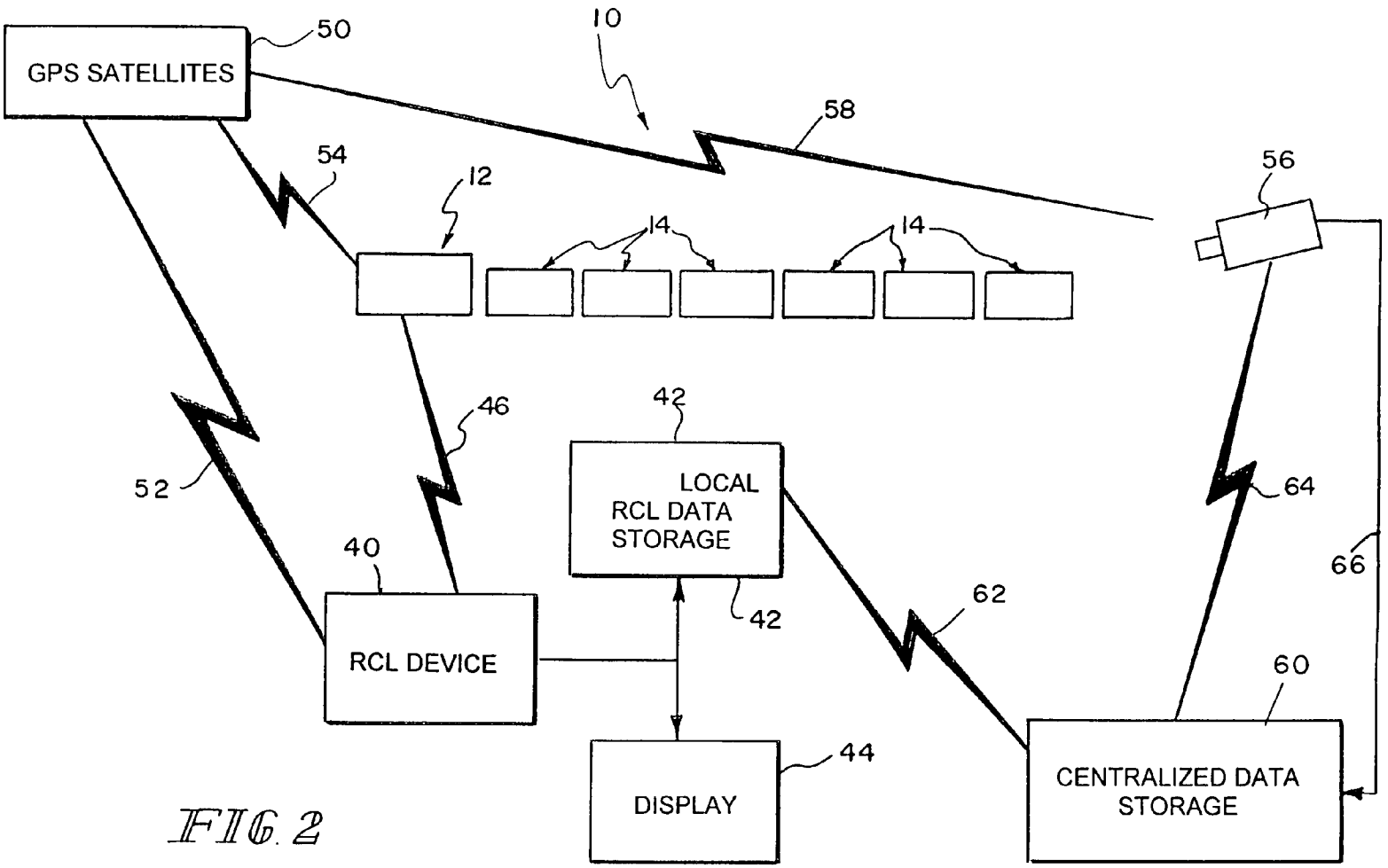
FIG. 2 is a schematic view of a hump yard, including an RCL device.

The ability to monitor, control and analyze the railroad hump yard is increased by the monitoring system 30 of FIG. 1. A centralized processing, display and storage unit 32 is provided. It includes, for example, processing display and storage control software of the LEADER system, which is described in U.S. Pat. No. 6,144,901 and available from New York Air Brake Corporation. Provided at 32 is a track data base of the hump yard. This is a profile, as well as the characteristics of the track profile. Additional information used by the software 32 includes the tower control commands to the retarding device 22 and the switch network 24. This is input 36. The telemetry of the car 16 from at least one point along the path 20 in the hump yard is obtained by unit 32. This may be from the individual car 16 itself, the locomotive 12 or from the sensors 28 adjacent to the hump track. The telemetry may include images, speed, acceleration and location. The location of the locomotive 12 may be determined by a GPS on the car in cooperation with a satellite, as illustrated in FIG. 2. The telemetry of the car 16 can be obtained from the car 16, the locomotive 12 pushing the car 16, or track side sensors 28. The telemetry can be calculated on the car 16, on the locomotive 12 or at the central unit 32. The central unit 32 communicates with the locomotive 12 and the car 16 via radio links 38.

The unit 32 uses the stored data base 32 of the hump yard, the commands to the retarding device 22 and switch network 24, and the telemetry of the car 16 at at least one point to calculate the telemetry of the car for the remainder of the path in the hump yard. The location of the car on the hump track profile 20 can be displayed and projected or played forward into time throughout the path in the hump yard. This will allow the operator to vary the retarding device 22 and the switching device 24 as the car moves. If the car 16 includes any remote electronic or radio-controlled brakes, these can also be applied by the communication from unit 32. The telemetry of the car 16 in combination with the tower control commands may be stored for later playback and analysis. The monitoring system 30 may be at the tower 26, in the locomotive 12 or in a portable device, for example, an RCL device, as illustrated in FIG. 2.

The monitoring system 30 has the ability to adjust the retarding device based on LEADER system's tuning of efficiencies from knowledge of car telemetry. This would provide data for adjusting the retarding device 22 based on current comparison of expected speed vs. actual speed. The tuning algorithm zeros-in on the retarding device's efficiency and allow for direct actuation or recommended or actual control of the retarding device 22. This would allow for adjustment of car speed for optimal coupling.

In a playback mode, the unit 32 will allow the train control commands to the retarding device 22 and the switching device 24 to be changed, and the telemetry of the car 16 is recalculated. This illustrates the effects of changing the commands. Also, the initial telemetry of the car 16 may be varied with a recalculation of the resulting telemetry. A combination of a change in the car's initial telemetry and the tower commands can also be performed in a playback mode. This allows analysis of the operation of the yard. Also, the telemetry required by the locomotive 12 to produce the changed telemetry of the car 16 can also be calculated by the unit 32.

In addition to LEADER algorithms used to perform dynamic calculations and both display and record the data collected, a type of LEADER exception or variance reporting as described, for example, in U.S. Pat. No. 6,748,303 and available from New York Air Brake Corporation, is provided. A standard freight application can be used to identify dynamic events that are of interest to the railroads.

A rail yard includes more than just the hump yard portion. As illustrated in FIG. 2, a yard may include the train 10 with locomotive 12 and cars 14, wherein the locomotive 12 is controlled by RCL device 40. The RCL device 40 may include substantially more information and intelligence to be displayed to the operator. It would include a local RCL data storage and program 42 and a display 44. The RCL device 40 has a transceiver to communicate with locomotive 12 via air waves 46. The location of the train on the track within the yard would be determined by the programming storage device 42 and displayed on display 44. This would give the operator a different view point of the locomotive within the yard, which would not be available from his perspective. This is especially true since the operator of the RCL device is generally at ground level. The locomotive 12 generally has a GPS device receiving signals from a satellite 50 via link 54. This information can be conveyed to the RCL device 40 to aid in locating the device's current position in the pre-stored data base for the track or yard at 42. The RCL device may also include a GPS transponder receiving signal by 52 from the satellite 50. This will determine its position within the yard. The device 42 would include software equivalent to that of the LEADER technology. This will allow the system 42 to drive the display 44 to show not only the location of the train 10 on the track or within the yard, but also allow display of forces throughout the train 10. This is important in the control and operation of the train 10 within the yard.

Also, within the yard, are generally cameras 56, which may include a GPS device communication with the GPS satellite 50 via radio link 58. The cameras 56 may also be connected with a centralized data storage 60 via radio link 64 or by hard wire 66. The transceiver of the RCL device 40 also can communicate with the centralized data storage 60 via radio link 62. The centralized data storage 60 correlates the telemetry of the train 10 with the commands from the RCL device 40 for further use. It also may be correlated with the video from the camera 56. This is achieved through time-stamp of the information from the locomotive 12 and the RCL device 40. This is correlated with the time-stamped information from the camera 56. By using the time stamp received from the GPS satellite 50, the accuracy and ease of correlation of information from the locomotive 12, RCL device 40 and camera 56 is increased.

The centralized data storage 60 may collect information from other locomotives and RCL device 40 within the yard. This information may also be transmitted from the locomotive and RCL devices to other RCL devices for displaying of their positions in the yard on the display 44 of the RCL device 40. That would allow an operator to know where other operators are in the work environment. Also, a tag may be worn by yard workers that would also transmit its position. That would allow locomotive operators (RCL or onboard) to know where other workers wearing tags are located and add a measure of safety. The software would include the ability to avoid co-occupation of any workspace by a locomotive and an RCL device (collision avoidance based on telemetry calculations).

The centralized data storage 60 allows playback of the information for management control and accident analysis of the yard. As in other LEADER systems, in playback, a simulation can take place by varying the telemetry of the train to see what results would occur. The software 42 has the ability of performing playback locally. The centralized data storage 60 may be at any remote location, for example, the tower 26 from FIG. 1.

The RCL device 40 of FIG. 2 may be used in the hump yard of FIG. 1 or in any yard control.

Figure 3:
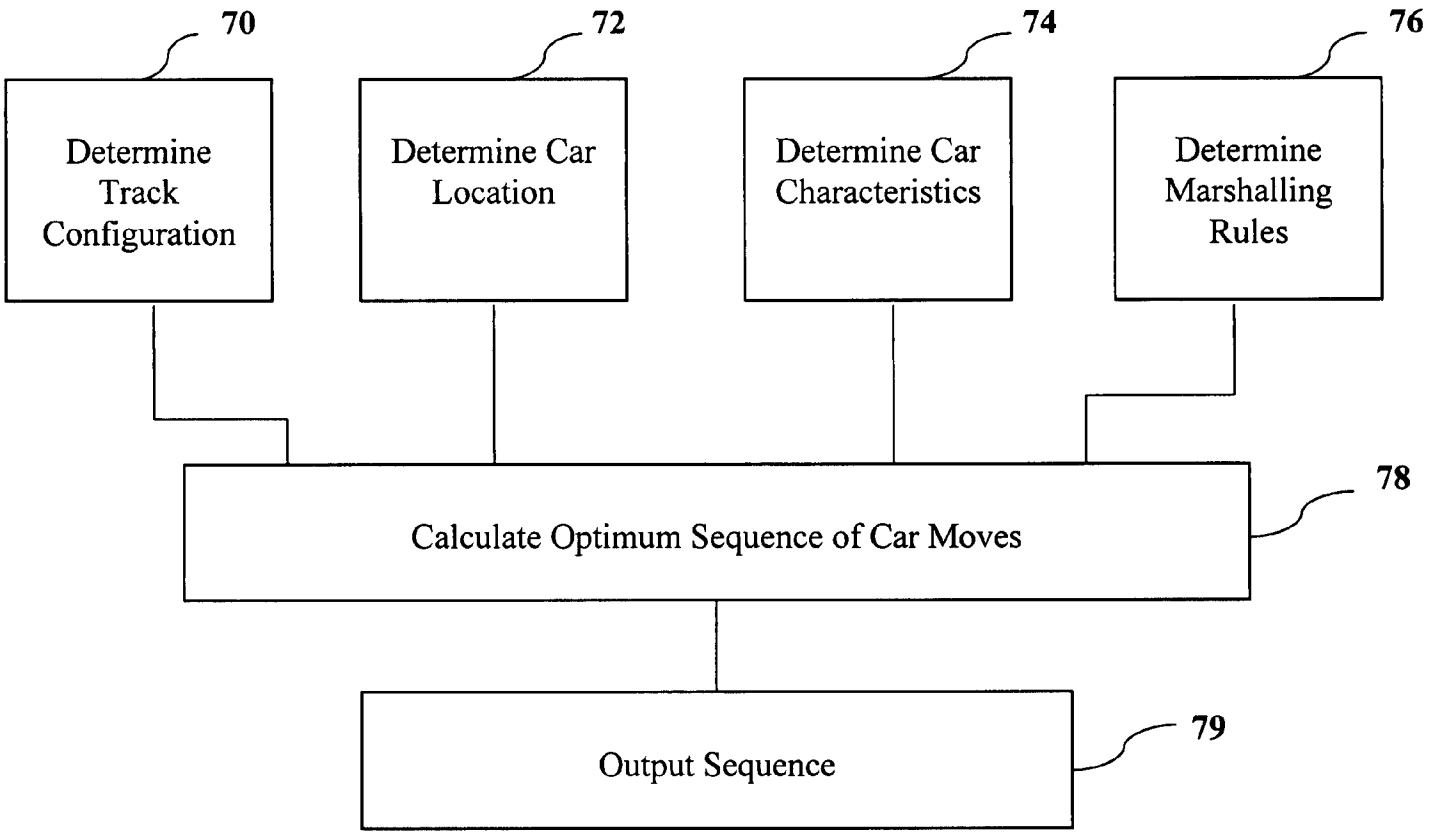
FIG. 3 is a flow chart of the method of determining a sequence of moves to marshal cars into a train according to the principles of the present disclosure.

Although there are may patterns of arranging the cars on various legs or spurs of a hump or classification yard as described in U.S. Pat. No. 6,418,854, moving the cars into their location in the classification yard and then ultimately from the various spurs into the marshall train are often not optimized. The present disclosure describes a method of determining an optimum sequence to move the car from the present position to the ultimate marshaled train. As illustrated in FIG. 3, a plurality of preliminary steps are performed before the calculation of the optimum sequence of car moves. The presteps may be performed simultaneously or in any given order. They are all needed for the ultimate calculation.

There is a determination of the track configuration at the site as shown by step 70. There is also a determination of the car location at the site at step 72. The car characteristics are determined at step 74. The marshalling rules are determined at step 76. From this information there is a calculation of the optimum sequence of car moves to marshall the train at step 78. The sequence is outputted at step 79. The output may be a printout, a screen display or a audio or oral message for the operators in the tower, on the locomotive or on the ground with an RCL. The operators can then perform the moves of the optimum sequence to marshall the cars into the train. While the moves are being performed, there can be a recalculation of the optimal sequence. This would include updating the location of the cars.

The determination of track configuration in step 70 may be performed by prestoring various track locations and using a GPS to determine the track site. The determination of track configuration can also include inputting the location and using a prestored list of track configurations. Determining the car location step 72 may also be performed by GPS on the individual cars and transmitted to the processor or manually inputted. The car characteristics determination at step 74 may be prestored, manually inputted by the operator or transmitted from a remote location to the processor. The marshalling rules determination at step 76 may be prestored in a processor, manually entered or transmitted from a remote location.

The car characteristics can include final destination and route to the final destination for each car. It may also include its tare weight, lading, length, type of lading and other characteristics which can be used in a determination of dynamic characteristics of the car in the ultimate train. As previously discussed the LEADER system provides these calculations based on inputted information. The marshalling rules at step 76 include the order of the cars within a subunit of the train as well as an order of the subunits of the train. This is based on ultimate destination and the route, as well as other instructions from the railroad.

The output at step 79 may also provide a checklist of the moves. If this is provided on a screen, the operator can update the checklist. This will allow the software to follow the marshalling moves. As previously indicated, a recalculation of the output moves can be performed as the checklist is updated. Also, if there are variations of the checklist, a recalculation of the optimum sequence can be calculated as well as a variance report generated. The processor in which the method is performed may be a handheld device, remote control locomotive device, a locomotive processor, or a processor in a tower.

Figure 4:
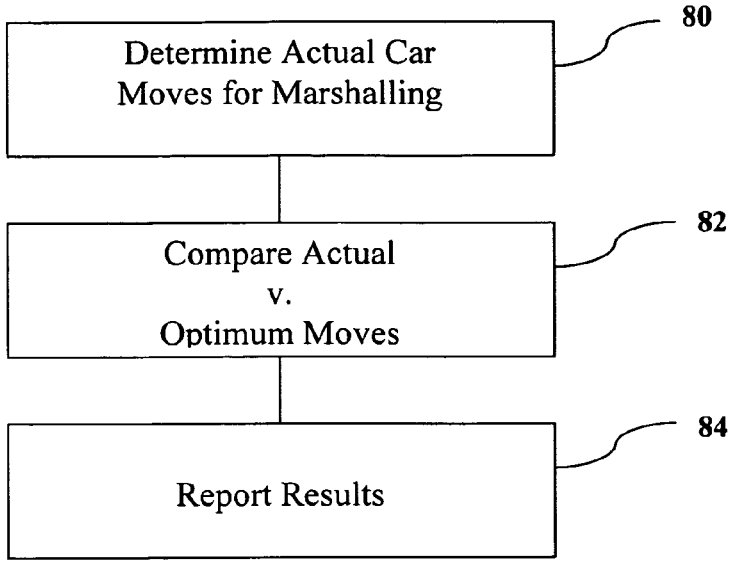
FIG. 4 is a flow chart of the method of exception reporting according to the principles of the present disclosure.

A method of preparing a variance report is illustrated in FIG. 4. The determination of actual car moves for the marshalling is at step 80. The actual car moves are determined against the optimum moves at step 82. A report of the results is provided at step 84. The determination of the actual car moves may be from continuing to monitor the location of the cars at step 72 and/or the input from the operator in response to the checklist. As previously discussed based on the results the optimum sequence may be recalculated for variations of the actual versus the optimum moves during the marshalling process, as well as after the completion of the marshalling of the train.

Figure 5:
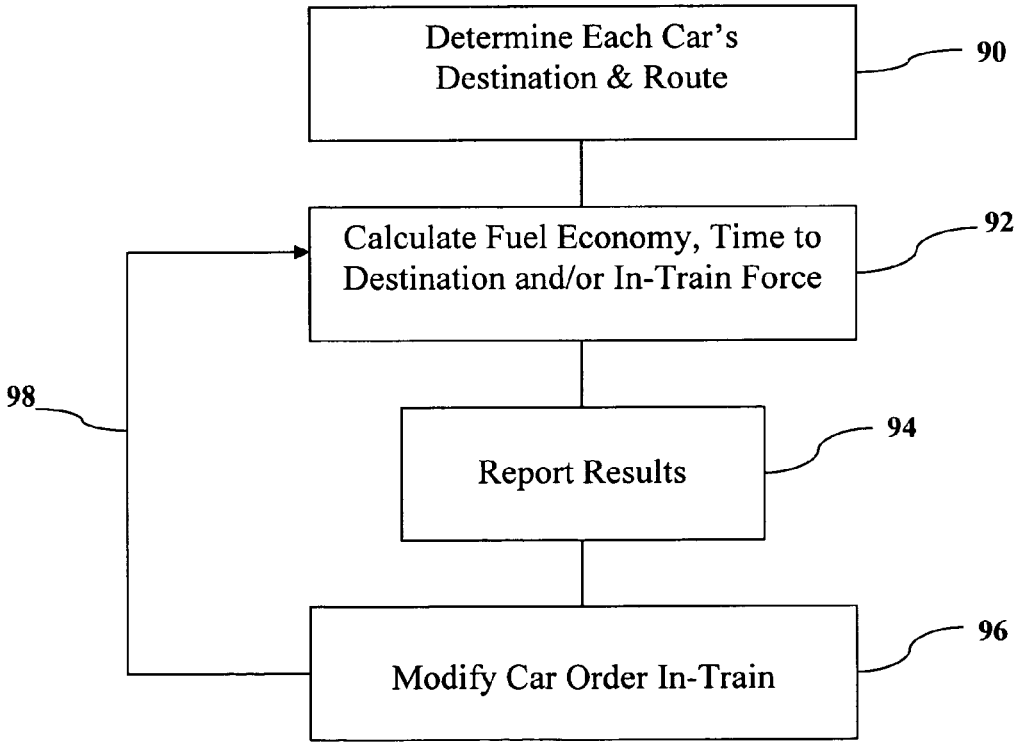
FIG. 5 is a flow chart of another method of determining a sequence of moves to marshal cars into a train according to the principles of the present disclosure.

With the availability of the LEADER software on the processor determination of the effect of the marshalling rules may be determined. As illustrated in FIG. 5, there is a determination of each car's destination and route at step 90. As previously discussed this is part of the determination of the marshalling rules at step 76. There is a calculation of one or more of fuel economy, time to destination and in-train forces at step 92. The results are reported at step 94. The report can be the results of the calculation as well as variance reports of the calculation if they violate the rules set by the railroad. These may be part of the marshalling rules. Based on the report results at step 94, there can be a determination at step 96 of modification of the order of cars in the train. This is looped back at step 98 to recalculate the fuel economy, time to destination and in-train forces. The modification of the car order at step 96 based on the report at step 94 may be automatically based on the variance report or may be initiated by the operator who review the report. The method of FIG. 5 may be operated independent of calculating an optimum sequence of the car moves or may be provided as part of the method of FIG. 3.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed:

1. A method optimizing marshalling rail cars into a train at a site comprising:

determining the track configuration at the site;

determining location on the tracks of cars to be marshaled;

determining characteristics of the cars to be marshaled;

determining marshalling rules;

calculating an optimum sequence of moves to marshal the cars into a train from the determined track configuration, location on the tracks of cars, characteristics of the cars and the marshalling rules; and outputting the sequence.

2. The method of claim 1, including performing the moves of the optimum sequence to marshal the cars into a train.

3. The method of claim 2, including recalculating of the optimum sequence while the moves are being performed.

4. The method of claim 1, wherein the output is one of a printout, a screen and oral.

5. The method of claim 1, wherein the sequence is outputted to a screen with a checklist and including updating the checklist in response to entries from an operator.

6. The method of claim 1, wherein the calculating is performed on a processor and the results of the determining steps are one of inputted in and stored on the processor.

7. The method of claim 6, wherein the site location and car locations are determined by a global position type system and inputted into the processor; and the track configuration at the site is determined by the processor from stored track configurations corresponding to the site location.

8. The method of claim 6, wherein at least two of the location of the cars, characteristics of the cars and marshalling rules are determined and transmitted to the processor.

9. The method of claim 6, wherein the processor is one of a handheld device, a remote control locomotive device, a locomotive processor and a tower processor.

10. The method of claim 1, wherein the site location and car locations are determined by a global position type system.

11. The method of claim 1, including determining the actual moves performed for the marshalling of the cars into the train and storing the actual moves.

12. The method of claim 11, including comparing the actual moves with the optimum sequence and preparing a report.

13. The method of claim 1, wherein the car characteristics include one or more of tare weight, lading, length, type of brake system and type of car.

14. The method of claim 1, wherein the marshalling rules include a car destination and a route to be taken to the destination.

15. The method of claim 14, including calculating one or more of fuel economy, time to the destination and in-train force of the marshaled train over the route to be taken and outputting a report of the calculation.

16. The method of claim 15, including changing the marshalling rules based on the report and recalculating one or more of fuel economy, time to the destination and in-train force of the new marshaled train over the route to be taken and outputting a report of the recalculation.

17. The method of claim 16, wherein the recalculation is performed one of automatically and in response to operator input.

18. The method of claim 1, wherein the method is performed remote from an operator and the sequence is transmitted to the operator.

19. A method marshalling rail cars into a train at a site comprising:

determining each car's destination and route to be taken to its destination;

calculating one or more of fuel economy, time to the determined destination and in-train force of a proposed marshaled train of cars over the route to be taken to the determined destination; and outputting a report of the calculation.

20. The method of claim 19, including changing the location of the cars in the marshaled train based on the report and recalculating one or more of fuel economy, time to the determined destination and in-train force of the new marshaled train of cars over the route to be taken to the determined destination and outputting a report of the recalculation.

21. The method of claim 20, wherein the recalculation is performed one of automatically and in response to operator input.

* * * * *